US009962951B2

(12) United States Patent
Cronin

(10) Patent No.: US 9,962,951 B2
(45) Date of Patent: May 8, 2018

(54) FRONT AND BACK PRINTING ON SECURITY DOCUMENT SUBSTRATES

(71) Applicant: Entrust Datacard Corporation, Shakopee, MN (US)

(72) Inventor: Patrick C. Cronin, Savage, MN (US)

(73) Assignee: ENTRUST DATACARD CORPORATION, Shakopee, MN (US)

( * ) Notice: Subject to any disclaimer, the term of this patent is extended or adjusted under 35 U.S.C. 154(b) by 0 days. days.

(21) Appl. No.: 15/291,573

(22) Filed: Oct. 12, 2016

(65) Prior Publication Data

US 2017/0106665 A1 Apr. 20, 2017

Related U.S. Application Data

(60) Provisional application No. 62/242,533, filed on Oct. 16, 2015.

(51) Int. Cl.

| | |
|---|---|
| ***B41J 2/325*** | (2006.01) |
| ***B41J 2/32*** | (2006.01) |
| ***B41J 33/44*** | (2006.01) |
| ***B41J 33/54*** | (2006.01) |

(52) U.S. Cl.

CPC ..... *B41J 2/32* (2013.01); *B41J 2/325* (2013.01); *B41J 33/44* (2013.01); *B41J 33/54* (2013.01)

(58) Field of Classification Search

None

See application file for complete search history.

(56) References Cited

U.S. PATENT DOCUMENTS

| | | | |
|---|---|---|---|
| 4,051,943 | A | 10/1977 | Hanazono et al. |
| 4,825,054 | A | 4/1989 | Rust et al. |
| 5,266,781 | A | 11/1993 | Warwick et al. |
| 5,865,547 | A | 2/1999 | Harris et al. |
| 6,231,249 | B1 | 5/2001 | Harris |
| 6,783,067 | B2 | 8/2004 | Kreuter et al. |
| 6,902,107 | B2 | 6/2005 | Shay et al. |
| 7,398,972 | B2 | 7/2008 | Schuller et al. |
| 7,434,728 | B2 | 10/2008 | Paulson et al. |
| 8,783,803 | B1 | 7/2014 | Clark |

(Continued)

FOREIGN PATENT DOCUMENTS

JP 094487 A * 5/2014

*Primary Examiner* — Matthew Luu
*Assistant Examiner* — Tracey McMillion
(74) *Attorney, Agent, or Firm* — Hamre, Schumann, Mueller & Larson, P.C.

(57) ABSTRACT

Techniques are described for printing on front and back surfaces of security document substrates in a manner that conserves use of print ribbon, thereby extending the life of the print ribbon. In general, the printer controller knows the content, as well as locations and colors, of what has been printed on the front or first surface of the security document substrate. The printer control also knows the content, as well as locations and colors, of what is to be printed on the back or second surface of the security document substrate. When the back surface of the substrate is to be printed, the printer controller determines, for a particular color, whether any of the printing on the back surface would overlap with the printing on the front surface. For locations where there would be no overlap, the printer can reuse the section of print ribbon that was used to print on the front surface to print on the back surface.

19 Claims, 4 Drawing Sheets

(56) References Cited

U.S. PATENT DOCUMENTS

| | | | | |
|---|---|---|---|---|
| 9,079,423 | B2 | 7/2015 | Bouverie et al. | |
| 2005/0082738 | A1* | 4/2005 | Bryant | B41J 3/50 271/10.01 |
| 2008/0219745 | A1* | 9/2008 | Bungert | B41J 3/38 400/521 |
| 2011/0293310 | A1* | 12/2011 | Kurihara | B41J 3/60 399/72 |
| 2013/0220984 | A1 | 8/2013 | Cronin et al. | |

* cited by examiner

FRONT AND BACK PRINTING ON SECURITY DOCUMENT SUBSTRATES

FIELD

Embodiments of this disclosure relate generally to systems, apparatus, and methods for printing on front and back surfaces of security document substrates to create personalized security documents, such as plastic cards and passports.

BACKGROUND

Many forms of personalized security documents are known including cards, such as plastic or composite cards, that can serve as identification cards, driver's licenses, financial cards (e.g., credit cards, debit cards), gift cards, phone cards, health cards, or the like, as well as passports. Personalized security documents often have images, data and other information printed on front and back surfaces thereof. A typical example of a conventional printing process on a card includes printing on the front surface of the card using a first section of print ribbon, thereafter flipping the card over, advancing the print ribbon, and printing on the back surface of the card using a second section of the print ribbon.

SUMMARY

Techniques are described for printing on front and back surfaces of security document substrates in a manner that conserves use of print ribbon, thereby extending the life of the print ribbon. In general, the printer controller knows the content, as well as locations and colors, of what has been printed on the front or first surface of the security document substrate. The printer controller also knows the content, as well as locations and colors, of what is to be printed on the back or second surface of the security document substrate. Assuming printing occurs on the front surface first, when the back surface of the substrate is to be printed, the printer controller determines, for a particular color, whether any of the printing on the back surface would overlap with the printing on the front surface. For locations where there would be no overlap, the printer can reuse the section of print ribbon that was used to print on the front surface to print on the back surface.

The security document substrates can be those used to produce personalized security documents such as cards, including plastic or composite cards, that can serve as identification cards, driver's licenses, financial cards (e.g., credit cards, debit cards), gift cards, phone cards, health cards, or the like, as well as passports or passport pages.

In one embodiment, a method of printing on a security document substrate includes using a print mechanism to print on a first surface of the security document substrate using a section of print ribbon. Thereafter, the security document substrate is flipped over so that a second surface thereof is available for printing using the print mechanism. The print mechanism is then used to print on the second surface of the security document substrate using the section of the print ribbon that was used to print on the first surface, wherein the printing on the first surface does not overlap the printing on the second surface.

In another embodiment, a method of printing on first and second opposite surfaces of a card includes printing on the first surface of the card using a section of a print ribbon, and thereafter printing on the second surface of the card using the section of the print ribbon, wherein the printing on the first surface does not overlap the printing on the second surface.

DRAWINGS

DETAILED DESCRIPTION

The techniques described herein can be utilized when printing on any type of substrate using a print ribbon to extend the life of the print ribbon. In one embodiment, the substrate is a security document substrate. Examples of a security document substrate include, but are not limited to, cards, including plastic or composite cards, that can serve as identification cards, driver's licenses, financial cards (e.g., credit cards, debit cards), gift cards, phone cards, health cards, or the like, as well as passports or passport pages. For sake of convenience, this detailed description will describe the substrate as being a card. However, it is to be realized that the techniques described herein can be applied to printing on other substrates as well.

The printing described herein can include the printing of personalized information on the card or the printing of non-personal information on the card. For example, printing the intended card holder's name, address, photograph, account number, employee number, signature, or the like, on the card are examples of printing of personalized information because the printing is specific to, or assigned to, the intended card holder. Printing a company logo, a contact phone number or email address, card use information, or other general card information are examples of printing that involve non-personal information because the printing is not specific to the intended card holder and identical non-personal printing is often applied to surfaces of cards of other card holders.

Figure 1:
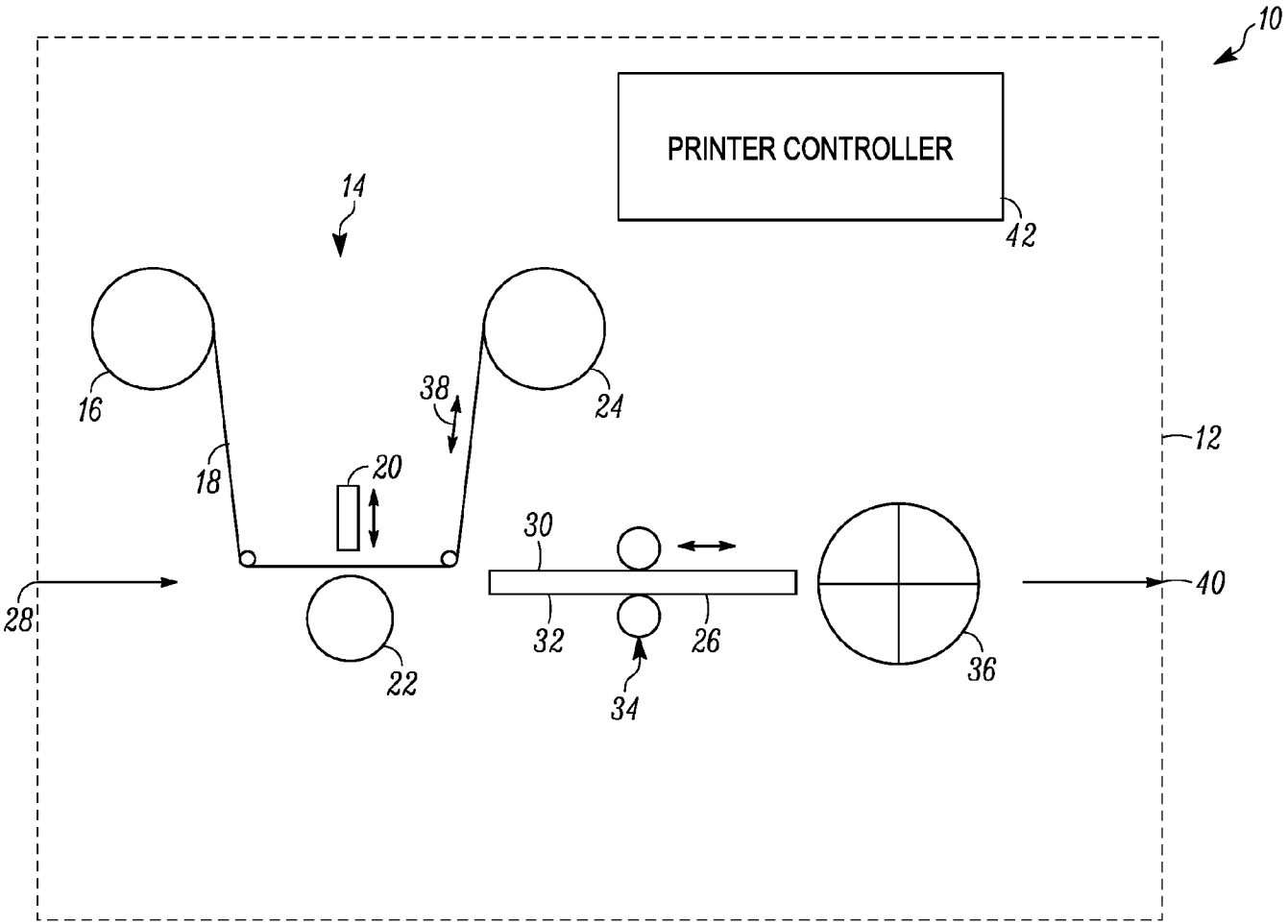
FIG. 1 illustrates a portion of a printer having a print mechanism that can be used to perform the printing described herein.

With reference to FIG. 1, an example of a portion of a printer 10 that can be used to implement the printing techniques described herein is illustrated. In general, the printer 10 includes a housing 12 (shown in dashed lines) in which a print mechanism 14 is disposed. The printer 10 can be a desktop card printer or a portion, such as a module or station, of a central issuance card machine.

A desktop card printer is a type of printer that is typically designed for relatively small scale, individual card personalization and production. In these machines, a single card to be personalized is input into the printer, which typically includes one or two personalization/processing capabilities, such as printing and laminating. These printers are often termed desktop printers because they have a relatively small footprint intended to permit the machine to reside on a desktop. Many examples of desktop printers are known, such as the SD or CD family of desktop card printers available from Entrust Datacard Corporation of Shakopee, Minnesota. Other examples of desktop card printers are disclosed in U.S. Pat. Nos. 7,434,728 and 7,398,972, each of which is incorporated herein by reference in its entirety.

A central issuance card machine is typically designed for large volume batch production of personalized cards, often employing multiple processing stations or modules, including one or more printing mechanisms, to process multiple cards at the same time to reduce the overall per card processing time. Examples of central issuance card machines include the MX and MPR family of central issuance machines available from Entrust Datacard Corporation of Shakopee, Minnesota. Other examples of central issuance machines are disclosed in U.S. Pat. Nos. 4,825,054, 5,266,781, 6,783,067, and 6,902,107, all of which are incorporated herein by reference in their entirety.

Returning to FIG. 1, in this example the print mechanism 14 is configured for direct to card printing in which an ink or dye is transferred by heat and pressure from a print ribbon onto a surface of the card. However, other types of print mechanisms that use a print ribbon can be used, include a retransfer printing mechanism.

The print mechanism 14 includes a ribbon supply 16 that supplies a print ribbon 18 for use in the printing. The print ribbon 18 is directed past a thermal print head 20 that is actuatable toward and away from an opposing platen roller 22. Used print ribbon 18 is wound onto a ribbon take-up 24.

A card 26 to be printed can enter in the direction of the arrow from an input 28. During printing, the card 26 travels in the nip formed between the print head 20 and the platen roller 22, in particular between the print ribbon 18 and the platen roller 22. A first surface 30 of the card 26, which can be the front surface or the back surface, faces upward toward the print ribbon 18, while a second surface 32, which can be front surface or the back surface, opposite the first surface 30 faces downward. Although the surfaces 30, 32 are described as facing upward and downward (i.e. the card travels in a horizontal orientation in the printer 10), respectively, the printer 10 can be configured such that the card travels in a vertical orientation with the surfaces 30, 32 facing forward and rearward.

After the first surface 30 is printed, the card 26 is transported by a suitable transport mechanism 34, for example one or more pairs of rollers, to a card reorienting mechanism 36 located downstream from the print mechanism 14. The card reorienting mechanism 36 receives the card 26 and flips or reorients the card 26 180 degrees so that the second surface 32 now faces upward while the first surface 30 faces downward. The card reorienting mechanism 36 can have any configuration suitable for achieving its function of reorienting the card 26. Examples of card reorienting mechanisms are described in U.S. 2013/0220984 and U.S. Pat. No. 7,398,972 each of which is incorporated herein by reference in its entirety.

After the card 26 is flipped, the card 26 is transported back to the print mechanism 14 to a position ready for printing on the now upward facing second surface 32. In one embodiment, the printing on the second surface 32 can occur as the card 26 is transported in a direction toward the input 28. In another embodiment, the card 26 can be transported back to just upstream of the print mechanism 14 and printing occurs on the second surface 32 as the card 26 moves in a direction back toward the card reorienting mechanism 36.

The ribbon supply 16 and the ribbon take-up 24 are also reversible so that the travel of the ribbon 18 can be reversed in direction as indicated by the arrow 38 after the printing occurs on the first surface 30. As discussed further below, this permits the section of the print ribbon 18 that was used to print on the first surface 30 to be brought back into position to be used again to print on the second surface 32.

After printing on the first and second surfaces 30, 32 of the card 26 is complete, the card 26 can be output from the printer 10 via the input 28. In other embodiments, the card 26 can be output from the printer 10 via an output 40 which can be located at any position on the printer 10, for example in a wall of the printer 10 generally opposite the input 28.

The printer 10 further includes a printer controller 42 that controls the operations of the printer 10. In some embodiments, the printer controller 42 can be part of and integrated into the printer 10 as in the example illustrated in FIG. 1. In other embodiments, the printer controller 42 can be externally located away from the printer 10, but suitably connected thereto for controlling the printer 10.

Figure 2B:
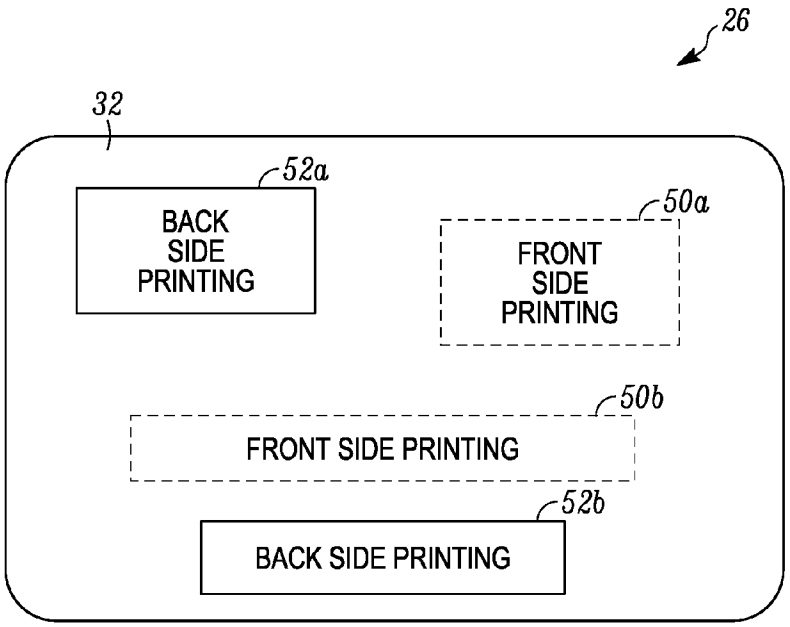
FIG. 2B illustrates a back or second surface of the card of FIG. 2A illustrating the locations of printing on the back surface (in solid lines) and locations of printing on the opposite front surface (in broken lines).
Figure 2A:
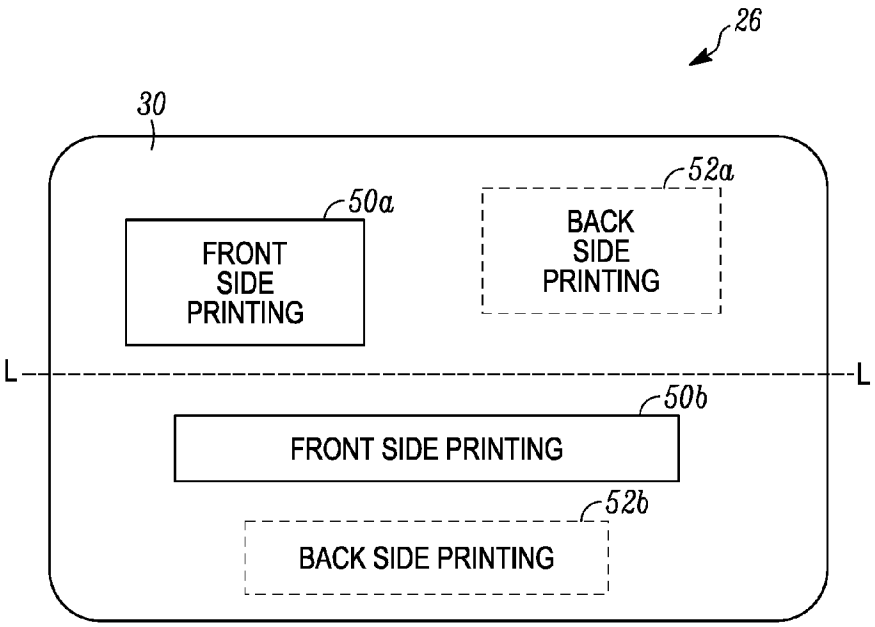
FIG. 2A illustrates a front or first surface of a security document substrate in the form of a card illustrating the locations of printing on the front surface (in solid lines) and locations of printing on the opposite back surface (in broken lines).

Referring now to FIGS. 2A and 2B, an example of intended printing locations on the surfaces 30, 32 of the card 26, and the relative positioning of the intended printing locations on the surfaces 30, 32, is illustrated. In these figures, it is assumed that the first surface 30 is the front surface of the card 26 and that the second surface 32 is the back surface of the card 26. In this example, the surface 30 is intended to have two areas of printing 50*a*, 50*b* (shown in solid lines in FIG. 2A; shown in broken lines in FIG. 2B) while the surface 32 is intended to have two areas of printing 52*a*, 52*b* (shown in broken lines in FIG. 2A; shown in solid lines in FIG. 2B).

Figure 5:
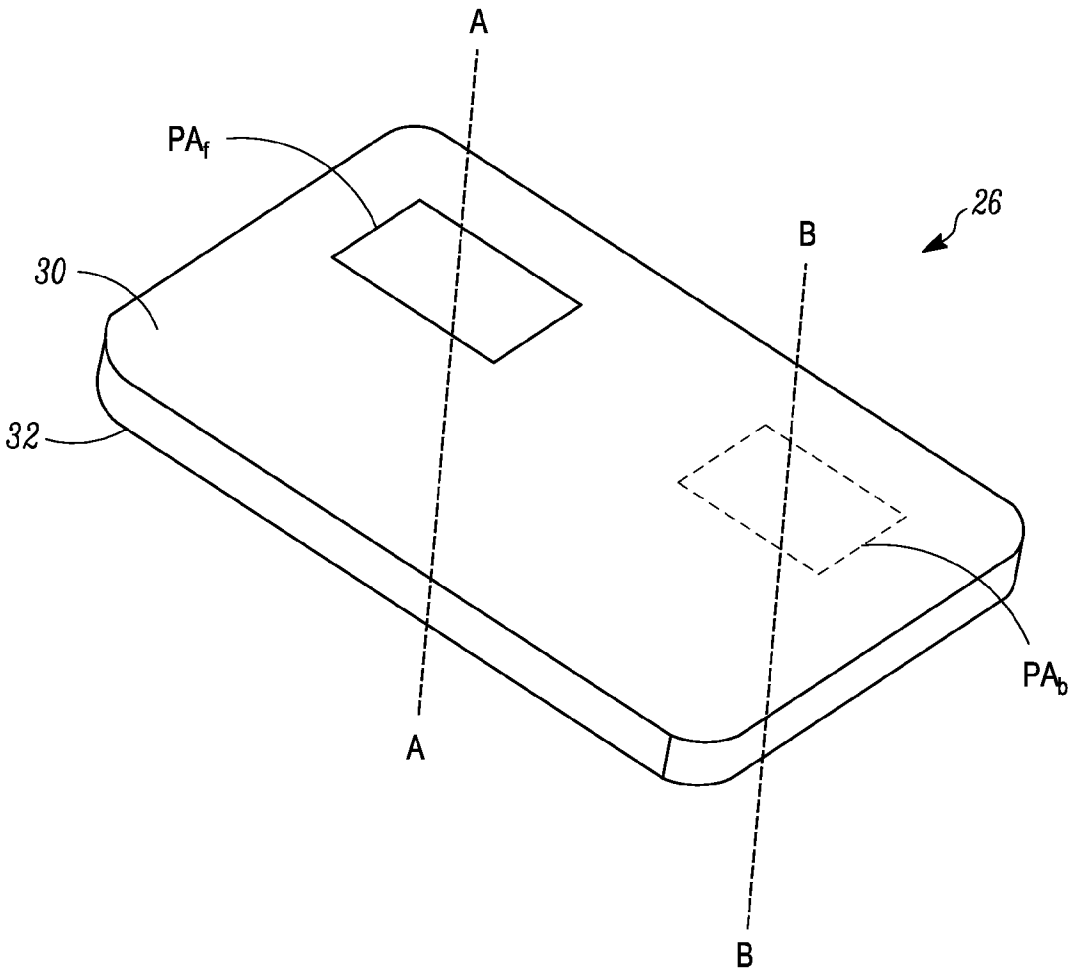
FIG. 5 is a perspective view of the card demonstrating the meaning of overlap, or lack of overlap, between the printed images on the surfaces of the card.

As suggested by FIGS. 2A and 2B, the areas occupied by the intended printing 50*a*, 50*b* on the surface 30 do not overlap with the areas occupied by the intended printing 52*a*, 52*b* on the surface 32. As used throughout this application, including the claims, overlap refers to any portion of the intended printing area on one surface of the card 26 not overlapping with or extending over any portion of the intended printing area on the opposite surface of the card 26. For example, referring to FIG. 5, there would no overlap between a printing area $PA_f$ on the surface 30, for example the printing area 50*a* or the printing area 50*b* in FIGS. 2A and 2B, and a printing area $PA_b$, for example the printing area 52*a* or the printing area 52*b* in FIGS. 2A and 2B, on the surface 32 if an axis A-A that extends perpendicular to the surfaces 30, 32 of the card 26 and that extends through any part of the printing area $PA_f$ does not extend through any part of the printing area $PA_b$ on the opposite surface. Likewise, there would no overlap between a printing area $PA_f$ on the surface 30 and a printing area $PA_b$ on the surface 32 if an axis B-B that extends perpendicular to the surfaces 30, 32 of the card 26 and that extends through any part of the printing area $PA_b$ does not extend through any part of the printing area $PA_f$ on the opposite surface.

Returning to FIGS. 2A and 2B, in conventional printing techniques, the printing 50*a*, 50*b* would be printed using a first section of print ribbon, while the printing 52*a*, 52*b* would be printed using a second section of print ribbon. However, the printing 50*a*, 50*b* only uses a portion of the dye or ink on the first section of the print ribbon, leaving the remaining dye or ink on the first section of the print ribbon unused. Because the printing 50*a*, 50*b* does not overlap the printing 52*a*, 52*b*, the unused dye or ink on the first section of the print ribbon can be used to print the printing 52*a*, 52*b* on the opposite surface 32.

Figure 3:
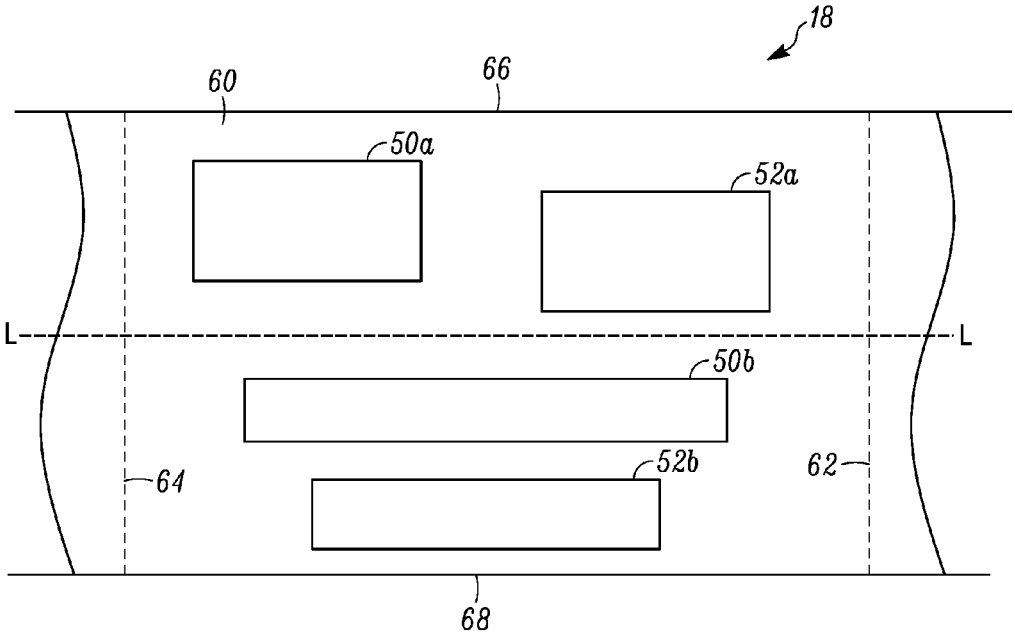
FIG. 3 illustrates a portion of a print ribbon showing a section of the print ribbon used to print on both the front and back surfaces in FIG. 2A and 2B.

FIG. 3 illustrates a section 60 of the print ribbon 18 used to print the areas of printing 50*a*, 50*b*, 52*a*, 52*b* in FIGS. 2A and 2B. Taking the areas of printing 50*a*, 50*b* as an example, when the areas of printing 50*a*, 50*b* are printed, the ink or dye is transferred from the ribbon section 60 onto the card surface 30 leaving blank areas or areas of reduced ink or dye in the section 60 corresponding to the locations of the areas of printing 50*a*, 50*b*. Those areas of the section 60 used to print the areas of printing 50*a*, 50*b* are considered no longer suitable for printing. However, the unused areas in the section 60 are suitable for further printing, and because the intended areas of printing 52*a*, 52*b* do not overlap the areas on the section 60 used to print the areas of printing 50*a*, 50*b*, the areas of printing 52*a*, 52*b* can be printed using the section of ribbon 60.

In one embodiment, the ribbon 18 can be a monochromatic ribbon containing a single color, such as black, yellow, magenta, cyan, or the like, of dye or ink. In this embodiment, the section 60 of the print ribbon may be a defined panel in the ribbon 18 (i.e. one of many distinctly identifiable panels), or the section 60 can simply be an area of the ribbon 18 (for example the area between the broken lines 62, 64 in FIG. 3) that has a length (measured in a straight line between the broken lines 62, 64 that is parallel to longitudinal edges 66, 68 of the ribbon 18) that is greater than the length (or longest dimension) of the card 26.

In another embodiment, the ribbon 18 can be a multi-color ribbon, such as a YMCK (y=yellow; m=magenta; c=cyan; k=black) ribbon, containing a plurality of sequential YMCK panels.

If some portions of the printing on one surface would overlap with the intended printing on the opposite surface, but some portions do not overlap, the non-overlapping portions can be printed using the same section of the print ribbon, while the overlapping portions can be printed using separate sections of the print ribbon. For example, if the intended printing 50*a* overlaps the intended printing 52*a*, but the printing 50*b* does not overlap the printing 52*b*, the same section of the print ribbon can be used to print both the printing 50*b* and the printing 52*b*, while a new section of print ribbon can be used to print the printing 52*a* due to the overlap.

In some embodiments, a percentage basis can be used to control whether the same section of print ribbon is used to print non-overlapping printing on the surface 32. For example, if the amount of non-overlapping printing on the surface 32 does not exceed a preselected amount of the total printing to be conducted on the surface 32, then a new section of print ribbon can be used to print both overlapping and non-overlapping data on the surface 32 as it may be determined to be faster to simply use the new section of print ribbon rather than have to reverse direction of the print ribbon to print the non-overlapping printing. However, if the amount of non-overlapping printing on the surface 32 exceeds the preselected amount of the total printing to be conducted on the surface 32, then the non-overlapping data can be printed using the previously used first section of the print ribbon The relative closeness of the areas of printing 50*a*, 50*b*, 52*a*, 52*b*, especially their closeness longitudinally (i.e. in the longitudinal direction L-L) can also be used as a factor in determining whether to reuse the section 60 of ribbon to print the areas of printing 52*a*, 52*b* on the surface 32. When reversing the direction of the print ribbon 18 to reposition the section 60 for printing on the surface 32, the section 60 may not be precisely repositioned, especially in the longitudinal direction L-L. Therefore, if an intended area of printing on the surface 32 will be too close to an area of printing on the surface 30 such that an area of the section 60 that was used to print on the surface 30 could unintentionally overlap an area to be printed on the surface, the printer controller 42 could determine that a new section of the print ribbon should be used to print the areas of printing on the surface 32 even if the raw print data suggests that there would be no overlap.

In some embodiments, the ability to reuse the print ribbon section can be selectively controlled on the printer by a user via a user selectable enable/disable feature. So when the ribbon section reuse feature is desired, the user can select the enable feature to enable reuse. When the ribbon section reuse feature is not desired, the use can select the disable feature.

Figure 4:
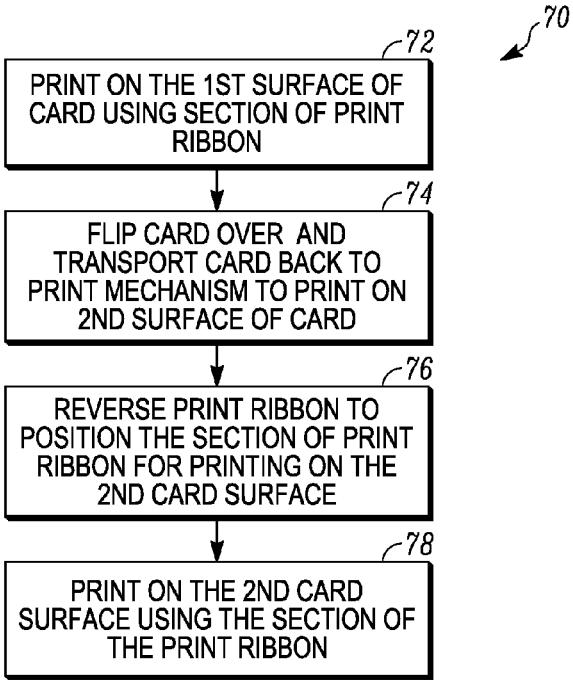
FIG. 4 illustrates an example method of printing described herein.

Turning to FIG. 4 together with FIG. 1, a method of printing on the card 26 will be described. The card 26 is input into the printer 10 with the surface 30 facing upward and the surface 32 facing downward. The card 26 is transported to the printing mechanism 14 to a position ready for printing on the surface 30. Based on the print data that has been input to the printer controller 42, at box 72 the printer controller 42 then causes the surface 30 to be printed using a section of the print ribbon 18.

After printing on the surface 30 is completed, the card 26 is transported to the card reorienting mechanism 36. At box 74, the card reorienting mechanism 36 flips the card 26 over so that the surface 32 is now facing upward, and the card is transported back to the print mechanism 14 for printing on the surface 32. If the card 26 is transported upstream of the print mechanism 14 for a subsequent forward repass through the print mechanism 14, at box 76 the print ribbon 18 is also reversed in direction to bring the section of the print ribbon that was used to print the surface 30 back to a position for reuse for printing on the surface 32. Alternatively, if the surface 32 of the card 26 is to be printed during a reverse pass through the print mechanism 14 in a direction toward the input 28, the print ribbon 18 is reversed in direction to the appropriate position for reuse in printing the surface 32.

Once the card 26 and the section of print ribbon are properly positioned relative to one another, at box 78 the printer controller 42 causes the print mechanism 74 to print on the card surface 32 using the same section of print ribbon that was used to print on the surface 30.

As discussed above, the printer controller 42 knows the content, locations and color(s) of what has been printed on the surface 30. When the surface 32 is to be printed after printing the surface 30, the printer controller 42 compares the printing to be printed on the surface 32 with the printing on the surface 30 to determine if any of the printing areas overlap. For example, the comparison can be performed by the printer controller 42 by comparing an image of the printed surface 30 with an intended printed image of the surface 32.

The comparison can be performed on a per color basis. For example, an image of the black (or yellow, or cyan, or magenta, etc.) printing on the surface 30 is compared with the intended black (or yellow, or cyan, or magenta, etc.) printing on the surface 32. For a particular color, any intended printing areas of that color on the surface 32 that do not overlap with a printing area for that color on the surface 30 can be printed using the same section of the print ribbon 18. In a specific example of black printing using a YMCK print ribbon containing YMCK panels, YMCK printing can be performed on the card surface 30. Thereafter, if it is determined that the intended black printing to be performed on the surface 32 does not overlap with the black printing performed on the surface 30, the YMCK print ribbon can be rewound to the K (or black) panel used to print on the surface 30, and that K panel is used to print the black printing on the surface 32. A similar approach can be used for the YMC panels as well.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method of printing on a security document substrate, comprising:

using a print mechanism to print on a first surface of the security document substrate using a section of a print ribbon;

flipping the security document substrate over so that a second surface thereof is available for printing using the print mechanism;

using the print mechanism to print on the second surface of the security document substrate using the section of the print ribbon that was used to print on the first surface, wherein the printing on the first surface does not overlap the printing on the second surface.

2. The method of claim 1, wherein the security document substrate comprises a card.

3. The method of claim 2, wherein the card comprises an identification card, a driver's license, a credit card, a debit card, a gift card, a phone card, or a health card.

4. The method of claim 1, wherein the print ribbon is monochromatic or multi-color.

5. The method of claim 1, wherein after the first surface is printed:

transporting the security document substrate to a reorienting mechanism located downstream from the print mechanism;

flipping the security document substrate using the reorienting mechanism; and transporting the flipped security document substrate back to the print mechanism.

6. The method of claim 5, further comprising moving the section of the print ribbon in a first direction while printing on the first surface; after the first surface is printed, moving the section of the print ribbon in a reverse direction opposite the first direction to re-position the section of the print ribbon for printing on the second surface; and moving the section of the print ribbon in the first direction while printing on the second surface.

7. The method of claim 1, wherein the section of the print ribbon has a beginning and an end;

wherein printing on the first surface begins near the beginning of the section of the print ribbon and comprising moving the section of the print ribbon in a first direction while printing on the first surface; and after printing on the first surface, moving the print ribbon in a second direction opposite the first direction so that the section of the print ribbon is positioned so that printing on the second surface begins near the beginning of the section of the print ribbon.

8. The method of claim 1, wherein the section of the print ribbon has a beginning and an end, and a length between the beginning and the end;

the security document substrate has a length that is less than the length between the beginning and the end.

9. The method of claim 1, wherein the section of the print ribbon includes a first area used to print on the first surface and a second area used to print on the second surface, the first area overlaps with the second area in a longitudinal direction, and the first area does not overlap with the second area in a lateral direction.

10. The method of claim 1, wherein the section of the print ribbon includes a first area used to print on the first surface and a second area used to print on the second surface, the first area overlaps with the second area in a lateral direction, and the first area does not overlap with the second area in a longitudinal direction.

11. A method of printing on first and second opposite surfaces of a card, comprising:

printing on the first surface of the card using a section of a print ribbon, and thereafter printing on the second surface of the card using the section of the print ribbon; wherein the printing on the first surface does not overlap the printing on the second surface.

12. The method of claim 11, wherein the card comprises an identification card, a driver's license, a credit card, a debit card, a gift card, a phone card, or a health card.

13. The method of claim 11, wherein the print ribbon is monochromatic or multi-color.

14. The method of claim 11, wherein after the first surface is printed:

transporting the card to a card reorienting mechanism;

flipping the card using the card reorienting mechanism; and transporting the flipped card from the card reorienting mechanism for subsequent printing on the second surface.

15. The method of claim 11, further comprising moving the section of the print ribbon in a first direction while printing on the first surface; after the first surface is printed, moving the section of the print ribbon in a reverse direction opposite the first direction to re-position the section of the print ribbon for printing on the second surface; and moving the section of the print ribbon in the first direction while printing on the second surface.

16. The method of claim 11, wherein the section of the print ribbon has a beginning and an end;

wherein printing on the first surface begins near the beginning of the section of the print ribbon and comprising moving the section of the print ribbon in a first direction while printing on the first surface; and after printing on the first surface, moving the print ribbon in a second direction opposite the first direction so that the section of the print ribbon is positioned so that printing on the second surface begins near the beginning of the section of the print ribbon.

17. The method of claim 11, wherein the section of the print ribbon has a beginning and an end, and a length between the beginning and the end;

the card has a length that is less than the length between the beginning and the end.

18. The method of claim 11, wherein the section of the print ribbon includes a first area used to print on the first surface and a second area used to print on the second surface, the first area overlaps with the second area in a longitudinal direction, and the first area does not overlap with the second area in a lateral direction.

19. The method of claim 11, wherein the section of the print ribbon includes a first area used to print on the first surface and a second area used to print on the second surface, the first area overlaps with the second area in a lateral direction, and the first area does not overlap with the second area in a longitudinal direction.

* * * * *